US011180282B2

(12) United States Patent
Roelofs et al.

(10) Patent No.: US 11,180,282 B2
(45) Date of Patent: Nov. 23, 2021

(54) CONTAINER MADE OF PLASTIC

(71) Applicant: Euro Pool System International B.V., Rijswijk (NL)

(72) Inventors: Christian Roelofs, Ringe (DE); Arthur F. Van Der Knaap, The Hague (NL)

(73) Assignee: Euro Pool System International B.V., DJ Rijswijk (NL)

( * ) Notice: Subject to any disclaimer, the term of this patent is extended or adjusted under 35 U.S.C. 154(b) by 59 days.

(21) Appl. No.: 15/776,431

(22) PCT Filed: Nov. 17, 2016

(86) PCT No.: PCT/EP2016/077965
§ 371 (c)(1),
(2) Date: Oct. 3, 2018

(87) PCT Pub. No.: WO2017/085171
PCT Pub. Date: May 26, 2017

(65) Prior Publication Data

US 2019/0031392 A1 Jan. 31, 2019

(30) Foreign Application Priority Data

Nov. 17, 2015 (DE) ..... 20 2015 106 211.7

(51) Int. Cl.
*B65D 21/032* (2006.01)
*B65D 6/18* (2006.01)
(Continued)

(52) U.S. Cl.
CPC ..... *B65D 11/1833* (2013.01); *B65D 11/22* (2013.01); *B65D 11/26* (2013.01);
(Continued)

(58) Field of Classification Search
CPC ..... B65D 21/0213; B65D 21/0212; B65D 11/26; B65D 11/28; B65D 11/22; B65D 85/34
See application file for complete search history.

(56) References Cited

U.S. PATENT DOCUMENTS 3,675,815 A * 7/1972 Rehrig ..... B65D 21/046 206/507
5,145,082 A * 9/1992 Craft, Jr. ..... B65D 1/38 16/421
(Continued)

FOREIGN PATENT DOCUMENTS

CH 361240 A 3/1962
DE 1825467 U 1/1961
(Continued)

OTHER PUBLICATIONS

International Search Report for application No. PCT/EP2016/077965 dated Feb. 13, 2017.

*Primary Examiner* — Stephen J Castellano
(74) *Attorney, Agent, or Firm* — Rouget F. Henschel; Potomac Law Group, PLLC

(57) ABSTRACT

The invention relates to a container (1) made of plastic, comprising a rectangular base (2) and four lateral walls (3, 4). The lower face of the base (2) has a first stacking contour (20) on the outer edge of the base, and the lateral walls (3, 4) have a second stacking contour (30, 40) on the upper edge region of the lateral walls. When containers (1) are stacked one over the other, the first stacking contour (20) of an upper container (1) and the second stacking contour (30, 40) of a lower container (1) engage with each other in a centering manner. The upper edge region of at least two opposing lateral walls (3, 4) is reinforced by at least one respective profiled reinforcement section (5) attached to the remaining lateral wall (3, 4) in a form-fitting and/or force-fitting manner, and the profiled reinforcement section (5) or each
(Continued)

Figure 1:
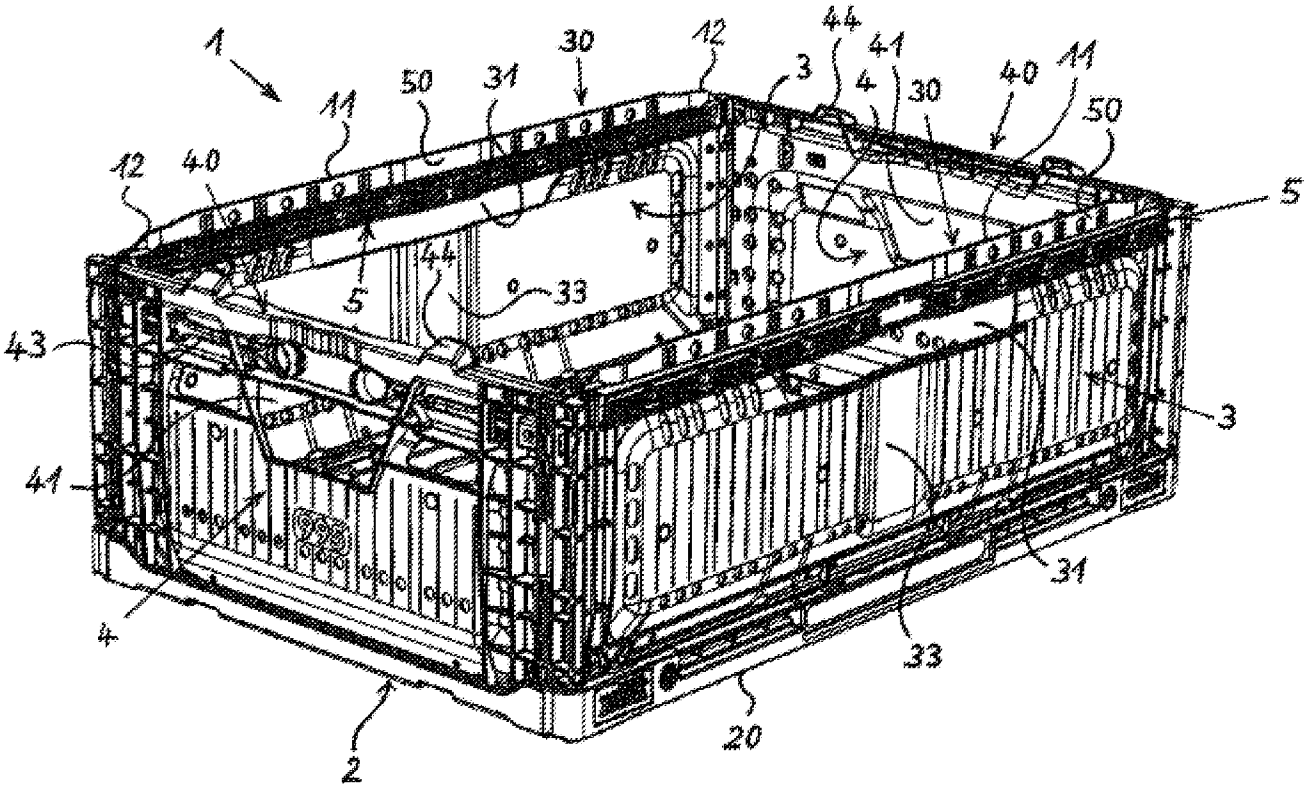

profiled reinforcement section has at least one profiled section web (50) on the section upper face facing away from the container (1), said profiled section web running in the longitudinal direction of the profiled reinforcement section (5) and forming a sliding path (11) for another container (1) to be placed thereon.

6 Claims, 13 Drawing Sheets

(51) Int. Cl.
*B65D 6/34* (2006.01)
*B65D 21/02* (2006.01)
*B65D 85/34* (2006.01)

(52) U.S. Cl.
CPC ..... *B65D 11/28* (2013.01); *B65D 21/0212* (2013.01); *B65D 21/0213* (2013.01); *B65D 85/34* (2013.01); *B65D 2205/02* (2013.01); *B65D 2519/00034* (2013.01); *B65D 2519/00069* (2013.01); *B65D 2519/00129* (2013.01); *B65D 2519/00174* (2013.01); *B65D 2519/00243* (2013.01); *B65D 2581/02* (2013.01)

(56) References Cited

U.S. PATENT DOCUMENTS

| | | | | |
|---|---|---|---|---|
| 5,295,632 | A * | 3/1994 | Zink | B65D 5/0055 229/117.16 |
| 6,168,038 | B1 | 1/2001 | Fischer | |
| 2016/0009448 | A1 * | 1/2016 | Hassell | B65D 1/34 206/511 |
| 2016/0229583 | A1 * | 8/2016 | Tsamourgelis | B65D 11/18 |

FOREIGN PATENT DOCUMENTS

| | | | |
|---|---|---|---|
| DE | 7910849 | U1 | 8/1979 |
| DE | 29601187 | U1 | 3/1996 |
| DE | 29710185 | U1 | 8/1997 |
| DE | 29713459 | U1 | 10/1997 |
| DE | 29902158 | U1 | 5/1999 |
| DE | 29904563 | U1 | 6/1999 |
| DE | 20114888 | U1 | 12/2002 |
| DE | 10160969 | A1 | 6/2003 |
| DE | 202014101556 | U1 | 7/2014 |
| EP | 0371565 | B1 | 4/1992 |
| EP | 0456070 | B1 | 6/1994 |
| EP | 0770552 | A1 * | 5/1997 |

* cited by examiner

CONTAINER MADE OF PLASTIC

The invention relates to a container made of plastic, comprising a rectangular base and for lateral walls, with the base showing at the bottom a first stacking contour at its outer edge, with the lateral walls comprising at their upper edge region a second stacking contour, and with, in case of a stacking of containers on top of each other, the first stacking contour of an upper container and the second stacking contour of a lower container engaging each other in a centering fashion.

A container is known from DE 20 2014 101 556 U1 for transportation and storage of goods, comprising a rectangular base and four lateral walls, erected on the base, stiff, and foldable, with the base showing at the bottom stacking edges and the lateral walls showing at the top respective a stacking surface, with the stacking edges and the stacking areas being embodied such that they allow to stack several containers on top of each other.

Containers for fragile goods, such as fruit, shall be embodied so that their lateral walls are pliable to a certain extent in order to avoid bruising the goods. However, this pliability of the lateral walls leads, on the other hand, to the problem of a greater risk of the upper edge of the lateral walls of lower, heavily loaded containers bulging in a stack of loaded containers, which renders the stack unstable.

Containers with a reinforced upper edge region are known from prior art.

A plastic container with a lid that can latch is described in the document DE 20 006 094 U1, in which at the container edge, at the side of a latch for the lid, facing the top edge of the container edge, at least one reinforcement rib is formed projecting radially inwardly and/or outwardly, and at least extending over a part of the perimeter of the container. The reinforcing rib additionally stabilizes the upper edge of the container and thus the sealing region between the container and the lid. Due to the fact that the reinforcing rib is formed at the lateral wall it is made from the same material as the remainder of the lateral wall so that, if the lateral wall is made from a synthetic showing a certain resilience or flexibility the strengthening effect of the reinforcing rib is low.

The document DE 296 01 187 U1 shows a load carrier made from foam material, particularly a particle foam, comprising at least a stacking edge and discusses the problem of increasing the ability to compensate loads. In order to solve the issue, here a reinforcing profile is provided at least over a portion of the stacking edge. The disadvantage of load carriers made from foam material is the need for relatively thick walls, with however only low mechanic stability and a useful volume relatively small in reference to the external dimensions being yielded. The use of such load carriers is limited to cases of only minor mechanical and thermal stress.

The document DE 297 10 185 U1 describes a package that can be stacked, particularly made from a foamed material, which shows an outer wall with a top edge, and with a bottom base, provided next to the inner lateral stops, with packages stacked adjacent on top of each other resting with the upper edge of the lower package and the bottom base of the upper package on top of each other and with the lateral stops in this stacked position being laterally at the inside next to the upper edge of the lower package. Here it is further provided that the support area of the upper edge is formed, at least over a portion of its lateral extension, inclined in reference to the side of the inner lateral stops and that the bottom base shows a respectively mating form. The outer wall may show at it top edge a wall reinforcing profile, with its top forming the support area for a stacked adjacent package resting on top thereof. Additionally, the wall reinforcing profile can be formed with a profile that can be plugged onto the top edge of the outer wall, showing preferably an approximately U-shaped cross-section. This package of prior art made from foamed material also requires relatively thick walls, with here too only low mechanic strength being obtained and a small useful volume in reference to the outer dimensions. The use of such packages is also limited to only low mechanic and thermal stress.

The objective of the present invention is therefore to provide a container of the type mentioned at the outset which shows high mechanic stability and strength, with here lateral walls potentially showing certain resilience to protect the goods inside the container and ensuring safe stacking of loaded containers on top of each other.

The first solution of the objective is attained according to the invention in a container of the type mentioned at the outset, which is characterized in that the upper edge section is reinforced at least at two lateral walls, opposite each other, by respectively at least one form-fitting and/or force-fitting reinforcement profile applied at the remaining lateral wall, and that the/each reinforcement profile comprises at its top, facing away from the container at least one profile section web extending in the longitudinal direction of the reinforcement profile, and forming a sliding track for another container to be placed on top thereof.

The invention advantageously generates the possibility to reinforce two or more lateral walls of the container with a reinforcement profile, with here it being possible to select the material independent from the material of the lateral wall. This way, in case of an appropriate material selection for the reinforcement profiles, a particularly strong reinforcing effect can be achieved. The lateral walls of the container, which are particularly stressed in case of containers being stacked on each other, can this way be stabilized with relatively minor technical expense such that any bulging of the top edge of loaded containers in the stack of containers can be excluded in usual stack heights and stack loads. Simultaneously, here advantageously the lateral walls may show certain resilience to protect goods inside the container. In order to facilitate the manual stacking of the containers on top of each other the/each reinforcing profile comprises at its top, pointing away from the container, at least one sliding track, extending in the longitudinal direction of the reinforcing profile, for another container to be placed thereon, forming a profiled section web. This way it is sufficient to initially place the upper container onto a lower container only partially overlapping, and then to shift the upper container along the sliding track of the lower container into its final stacked position.

In another embodiment of the container it is provided that the stacking contour of the/each lateral wall, comprising a reinforcement profile, is respectively embodied at the top of the reinforcement profile. In this embodiment the stacking contour is particularly stable and resistant to wear and tear, which contributes to a long life span of the container.

In an alternative embodiment of the container the stacking contour of the/each lateral wall comprising a reinforcement profile is respectively embodied at the top at the upper edge of the lateral wall, separated from the reinforcement profile. The embodiment of the container offers the option to use the container also without such reinforcement profiles, for example when used for lightweight goods.

As mentioned above, the reinforcement profile is fastened in a force-fitting and/or form-fitting fashion at the remaining lateral walls. For the concrete embodiment of this compound it is provided in a first embodiment that the/each reinforcement profile comprises in a lower section, facing the lateral wall, a groove open towards the bottom or a brace pointing downward such that at the top edge of the remaining lateral wall a brace pointing upwards or a groove open towards the top is formed, and that the reinforcement profile is latched or jammed or pushed or welded or adhered with its groove on the brace of the lateral wall or with its brace is latched or jammed or inserted or welded or adhered in the groove of the lateral wall. The reinforcement profile is here also connected from the top with the corresponding lateral wall during the production of the container.

In an alternative embodiment it is provided that the/each reinforcement profile comprises in a lateral section facing the lateral wall a groove, open towards the side, or a bracket pointing to the side, such that at the top edge of the remaining lateral wall a brace pointing to the side or a groove open towards the side is formed, and that the reinforcement profile is latched or jammed or pushed or welded or adhered with its groove to the brace of the lateral wall or with its brace is latched or jammed or inserted or welded or adhered in the grove of the lateral wall. Here, the connection of the reinforcement profile occurs with the corresponding lateral wall from the side, thus in a direction perpendicular to the wall level.

In order to ensure that even in case of a rough insertion process of the container the integrity of the lateral wall and the reinforcement profile is maintained it is suggested that cooperating latching elements are formed at the lateral wall and at the corresponding reinforcement profile. These latching elements engage each other upon application of a reinforcement profile at the remaining lateral wall such that an unassisted release of the reinforcement profile from the lateral wall is excluded, but a potentially desired disassembly or replacement of the reinforcement profile is possible, without resulting in destruction, here.

A second solution of the above-stated objective is yielded according to the invention in a container of the type mentioned at the outset which is characterized in that the upper edge region of at least two opposite lateral walls is reinforced by at least one reinforcement profile arranged in or at the lateral wall and extending in the direction of the longitudinal direction of the lateral wall, and that the/each reinforcement profile is arranged offset in reference to the stacking contour towards the bottom. In this container the reinforcement profile has only the function of reinforcement and can therefore be used optimized for this purpose without any restrictions.

A preferred further development of the container according to the second solution provides that the upper edge section is embodied at least at two opposite lateral walls with at least one sliding track each, separated from the reinforcement profile, and extending in the longitudinal direction of the lateral wall for another container to be placed thereon. This way, even for the second container a particularly beneficial stacking of containers on top of each other is ensured by the person handling them.

It is further provided according to the invention that the/each lateral wall comprising a reinforcement profile is an injection molded part made from two or more components, which is generated by a successively performed casting process of at least two different synthetics into a lateral wall or container casting mold, with one synthetic being provided for the reinforcement profile representing a reinforced synthetic and one synthetic for the remaining lateral wall or the remaining container representing a non-reinforced synthetic; in this embodiment the container can be advantageously produced as a mass-produced part.

As an alternative, it is possible that the/each lateral wall comprising a reinforcement profile is generated by inserting a reinforcement profile, formed as a reinforced pre-produced part, into a lateral wall or a container injection mold and a subsequent injection of a non-reinforced synthetic forming the remaining lateral wall or the remaining container, into the lateral wall or container mold. This embodiment also allows a cost-effective mass production.

In order to avoid undesired deformations of the reinforced lateral walls of the container due to perhaps different thermal expansion coefficients of the reinforcement profile and the remaining lateral wall the invention further suggests that in or at the/each of the lateral walls comprising a reinforcement profile the reinforcement profile is not fused to the synthetic of the lateral wall and is displaceable in reference to the remaining lateral wall to a minor extent.

As an alternative, in the second container according to the invention the/each reinforcing profile can be latched or jammed or pushed together or welded or adhered to the corresponding lateral wall.

Further it is preferably provided for the container that the upper edge region of two longer lateral walls, opposite each other, is reinforced by a reinforcing profile continuous over the length of the corresponding lateral wall. This way the naturally greater risk of any bulging is effectively counteracted in the longer lateral walls.

Alternatively, the container may also be embodied such that the upper edge region of all lateral walls is reinforced by a reinforcement profile continuous over the length of the corresponding lateral wall.

When in a container the vertical force deduction in the stack of containers occurs primarily over the corner regions of the stacked containers, it is beneficial for the upper edge region of the end sections of two lateral walls adjacent at the corners of the container to be reinforced by a reinforcing profile extending in an angular fashion.

A particularly strong reinforcing effect can be yielded if the upper edge region of all lateral walls is reinforced by a single frame-like, circumferential reinforcement profile.

It is further provided preferably that the lateral walls per se are made from a non-reinforced thermoplastic synthetic and that the/each reinforcement profile is made from a fiber-reinforce synthetic or metal. The lateral walls or the container per se can therefore be produced from a relatively cost-effective material, particularly as injection molded parts. The reinforcement profiles can be made from a more stable material. The fiber reinforced synthetic is here preferably reinforced with glass, carbon, or natural fibers, with the reinforcement profile made therefrom also being advantageously produced by way of injection molding.

For the above-described containers with sliding tracks another embodiment provides that, below the lateral walls comprising the sliding tracks, sections are located of the stacking contour of the base, embodied with one groove each such that the sliding tracks and the grooves are respectively embodied so that in case of an upper container being placed onto a lower container in a position offset in the longitudinal direction of the sliding tracks and the grooves the upper container rests in an elevated position on the sliding tracks of the lower container in a displaceable fashion and that in or after any displacement of the upper container into a position coinciding with the one of the lower container the sliding tracks assume a stacked end position in the grooves, lowering the upper container. The container showing this embodiment has several advantages. At first, it allows a placement of an upper container onto a lower container with an offset of the containers in reference to each other and a subsequent displacement of the upper container on the lower container into a coinciding stacked position, which particularly facilitates a manual stacking process of the containers, particularly in the loaded condition, by the handling personnel. During this sliding of the upper container on the container located underneath the upper container slides first at an elevated position on the sliding tracks of the lower container and only at the end of the displacement process it drop into its final stacked position. This way, during the shifting advantageously a higher or greater space is yielded between the two containers, concretely between the transported goods, such as fruit, in the lower container, on the one side, and the bottom of the base of the upper container, on the other side. This way, fragile goods in the lower container, particularly fruit, projecting slightly upwards beyond the edge of the container cannot be damaged by friction or scratching.

Due to the fact that when stacking the containers primarily vertical forces develop, here preferably the sliding tracks are embodied respectively as vertically aligned, continuous or interrupted braces.

For any shockproof transition of an upper container from an initially displaced, elevated position into a lowered final stacked position the invention provides that every sliding track is stepped in its end regions or sloped or rounded.

For the practical use of the containers sliding tracks are beneficial on two long lateral walls. Alternatively, sliding tracks on two short lateral walls may be provided.

In order to allow a safe mixed stacking of containers according to the invention with conventional container of the same basic dimensions it is provided that the two lateral walls not equipped with sliding tracks show at the top respectively one or more projections, distanced from each other in the longitudinal direction of these lateral walls, securing a conventional container placed upon a container according to the invention from shifting in the longitudinal direction of the sliding tracks, with the height of these projections being equivalent to the height of the sliding tracks.

The containers according to the invention may be stiff containers, with their lateral walls being embodied in one piece with the base or connected thereto in a fixed manner, or they may be foldable containers, with their lateral walls being connected to the base in an articulate fashion.

In the following, exemplary embodiments of the containers according to the invention are explained based on a drawing. The figures of the drawing show:

FIG. 1 a first container with respectively one reinforcement profile at two longer lateral walls located opposite each other, in a view diagonally from the top, FIG. 2 the container of FIG. 1 in a front view of one of the longer lateral walls with a reinforcement profile fastened thereat, FIG. 3 one of the longer lateral walls of the container of FIG. 1 and a reinforcement profile not yet fastened thereat in a view diagonally from the top, FIG. 4 a portion of the longer lateral wall and the reinforcement profile of FIG. 3 connected thereto in an enlarged detail, FIG. 5 a portion of the longer lateral wall and the reinforcement profile of FIG. 3 connected thereto in an enlarged illustration, partially in a front view and partially in a first vertical section, FIG. 6 a portion of the longer lateral wall and the reinforcement profile of FIG. 3 connected thereto in an enlarged illustration, partially in a front view and partially in a second vertical section, FIG. 7 a container with respectively one reinforcement profile at two opposite longer lateral walls, in a front view of the shorter lateral wall, FIG. 8 another container with one reinforcement profile each at two opposite longer lateral walls, in a view diagonally from the top, FIG. 9 one of the longer lateral walls of the container of FIG. 8 and a reinforcement profile not yet connected thereto, in a view diagonally from the top, FIG. 10 the lateral wall of FIG. 9 with the reinforcement profile connected thereto in a view diagonally from the top, FIG. 11 one of the longer lateral walls of another container and a reinforcement profile not yet connected thereto in a view diagonally from the top, FIG. 12 the lateral wall of FIG. 11 and the reinforcement profile connected thereto in a view diagonally from the top, and FIG. 13 one of the longer lateral walls of another container and a reinforcement profile connected thereto in a view diagonally from the top.

In the following description of the figures identical parts in the various figures of the drawing are always provided with the same reference character so that not every figure of the drawing requires an explanation for each reference character.

FIG. 1 of the drawing shows a container 1 with a base 2, with two opposite first longer lateral walls 3 and with two opposite shorter lateral walls 4, seen in a view diagonally from the top. The container 1 is here embodied as a folding container, in which the lateral walls 3, 4 are connected in an articulate fashion to the base 2 such that they are adjustable between the erected position of use shown in FIG. 1 and the resting position in which the four lateral walls 3, 4 are folded inwardly to the base 2.

Furthermore, the lateral walls 3, 4 are provided in a manner known per se respectively with a handle opening 31, 41 as well as detachable locking means 43 for a mutual fixing of the lateral walls 3, 4 in their position of use.

Via a lower stacking contour 20 at the outer edge region of the base 2 and respectively one upper stack and contour 30, 40 each at the top edge of the lateral walls 3, 4 several containers 1 can be stacked over top engaging each other in a centering fashion.

The base 2 and the lateral walls 3, 4 are here injection molded parts comprising a thermoplastic synthetic, with at least the lateral walls 3 comprising flexible wall sections 33 with a certain resilience in order to protect the goods stored or transported in the container 1.

In order to allow stacking such containers 1 in a safe and reliable fashion over top of each other without this leading to any bulging of the top edge of the lateral walls 3 towards the outside, particularly in the lower containers 1 in a stack of loaded containers 1, here one reinforcement profile 5 is respectively provided at the two opposite longer lateral walls 3 in a form-fitting fashion, in this case latched. The reinforcement profiles 5 are made from a material, particularly a fiber-reinforced synthetic or metal, which is more stable than the material the lateral walls 3 are made from per se, commonly a non-reinforced synthetic. The reinforcement profiles 5 ensure therefore that the lateral walls 3 in their upper edge region show a particularly high stability, thus preventing any undesired bulging of the upper edge of the lateral walls 3 in a stack of containers.

At the top, each reinforcement profile 5 shows a profiled section web 50 pointing upwards, extending in the longitudinal direction of the reinforcement profile 5 and the corresponding lateral wall 3. The profiled section web 50 form at their top a sliding track 11, on which an upper container 1, after an only partially overlapping placement, can be displaced on a lower container 1 easily into its final stacked position.

The end sections 12 of the sliding track 11 are sloped in order to displace the upper container 1 in an elevated position in reference to the lower container 1 and to lower the upper container 1 only immediately prior or upon reaching the coinciding position of the upper container 1 in reference to the lower container 1. This way the goods in the lower container 1 are protected from damages by the shifting of the upper container 1.

In order to allow placing conventional containers with the same basic dimensions safely and stacked on the container 1, on the upper edge of the shorter lateral walls 4 formed by the upper stacking contour 40 respectively two projecting protrusions 44 are formed at a distance from each other. On the one hand, these projections 44 block a conventional container placed upon the container 1 from any undesired shifting along the sliding tracks 11 beyond a coinciding stacking position in reference to the container 1 located underneath.

Figure 2:
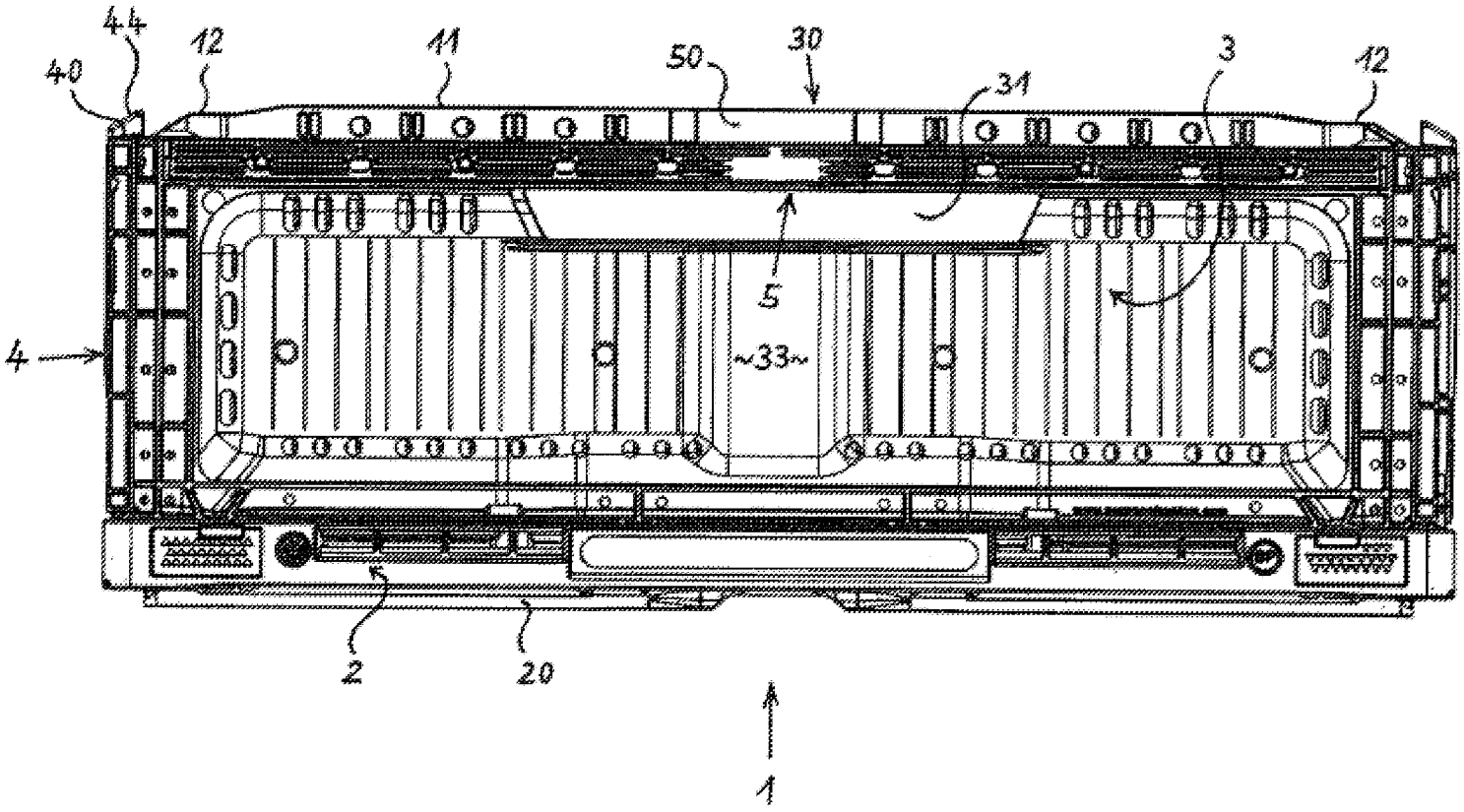

FIG. 2 shows the container 1 of FIG. 1 in a front view of one of the longer lateral walls 3 with a reinforcement profile 5 fastened thereat. At the bottom of FIG. 2 the base 2 is visible with its stacking contour 20. The reinforcement profile 5 is connected to the lateral wall 3 at the upper edge of the lateral wall 3. A handle opening 31 is provided underneath a central section of the reinforcement profile 5 in said lateral wall 3. A central area of the lateral wall 3 framed by the four edge sections of the lateral wall 3 forms the flexible wall section 33, which shows certain resilience. The profiled section web 50 is visible at the top of the reinforcement profile 5, which forms the stacking contour 30 of the lateral wall 3 as well as one of the sliding tracks 11 with the sloped sliding track end sections 12.

Figure 3:
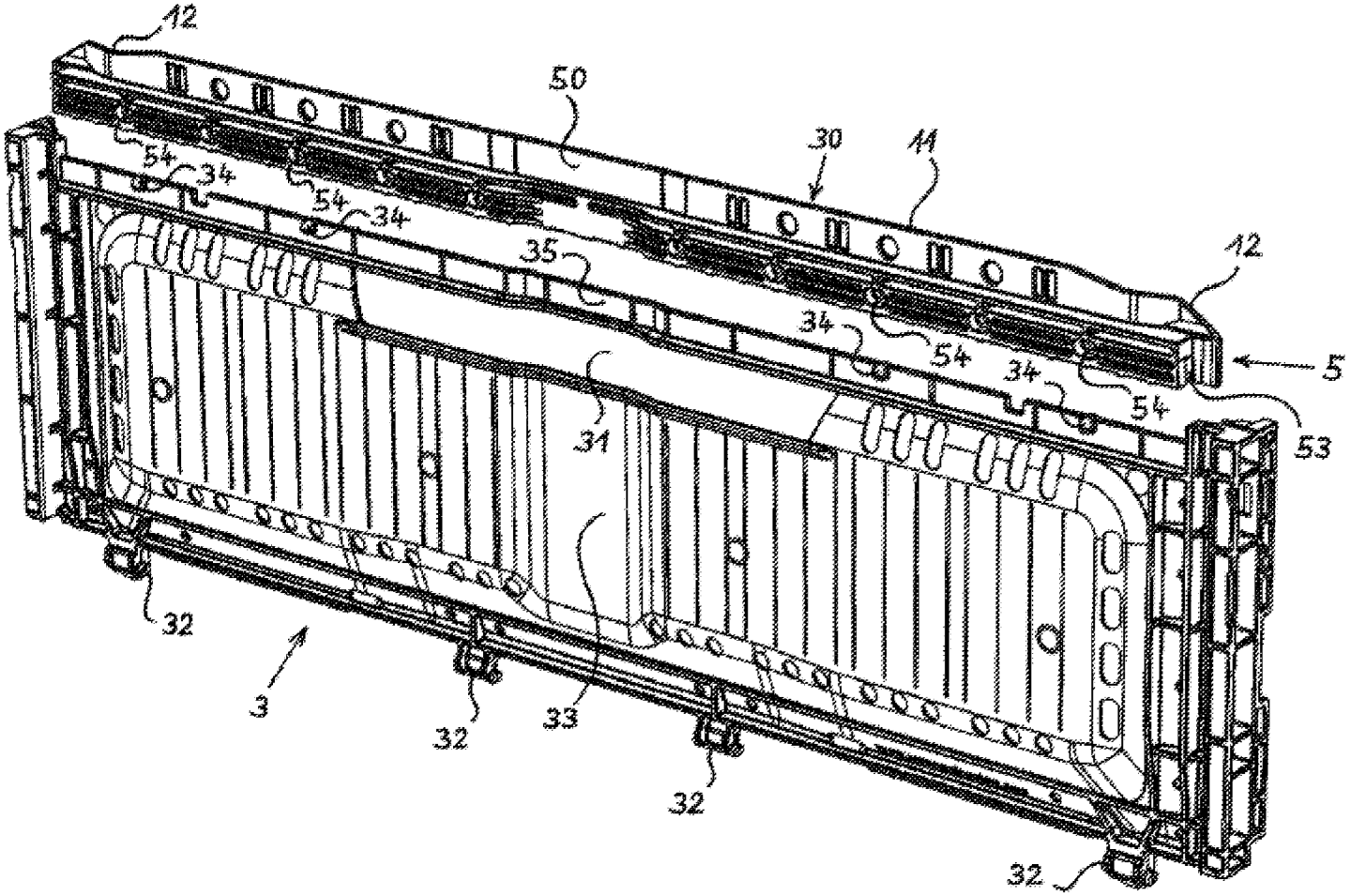

FIG. 3 shows one of the longer lateral walls 3 and a reinforcement profile 5, not yet fastened thereat, in a view diagonally from the top. The lateral wall 3 shows at its top edge a brace 35 pointing upwards, at which in regular intervals latching elements 34 are provided in the form of latching cams projecting from the area of the brace. The reinforcement profile 5, shown above the lateral wall 3 and not yet connected thereto shows at its bottom a groove 53, by which the reinforcement profile 5 can be plugged on in a form-fitting fashion in the vertical direction from the top towards the bottom onto the brace 35. Here, via latching elements 54 in the form of latch openings appropriately positioned in the reinforcement profile 5, the locking profile 5 is latched in a securely operating fashion with the latch elements 34 at the lateral wall 3, however detachable if necessary, generating the desired reinforcement and stiffening of the upper edge region of the lateral wall 3.

At the bottom edge of the lateral wall 3 several, in this case four, hinges 32 are visible in FIG. 3, by which in a manner known per se the lateral wall 3 can be connected in an articulate fashion to the base 2 of the container 1, not shown here.

Figure 4:
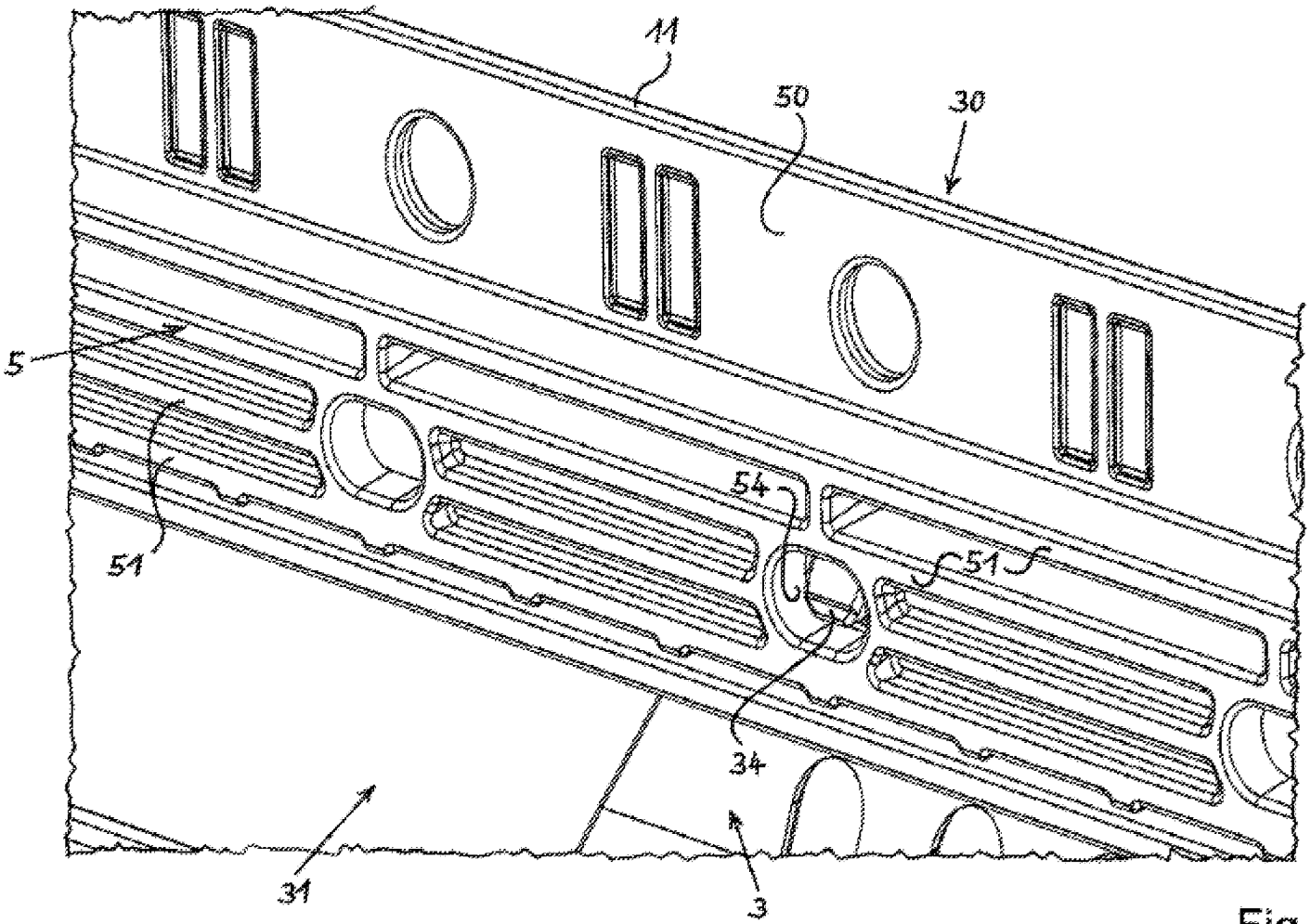

FIG. 4 shows in an enlarged detail a portion of the longer lateral wall 3 and the reinforcement profile 5 of FIG. 3 connected thereto. At the bottom left of FIG. 4 a portion of the lateral wall 3 is shown with the handle opening 31. The reinforcement profile 5 extends above thereof.

At the right above the handle opening 31 one of the pair of latching elements 34, 54 is discernible with the latching element 34 of the lateral wall 3 showing the form of a latching cam, which engages the latching element 54 of the reinforcement profile 5 formed as a latch opening.

Furthermore, FIG. 4 illustrates that the reinforcement profile 5 shows on its side facing the interior of the container several, parallel extending lateral profile wings 51, which result in the reinforcement profile 5 to be particularly rigid with relatively low material use.

At the top of the reinforcement profile 5 its vertical profiled section web 50 extends, with its top forming the sliding track 11 of the lateral wall 3.

Figure 5:
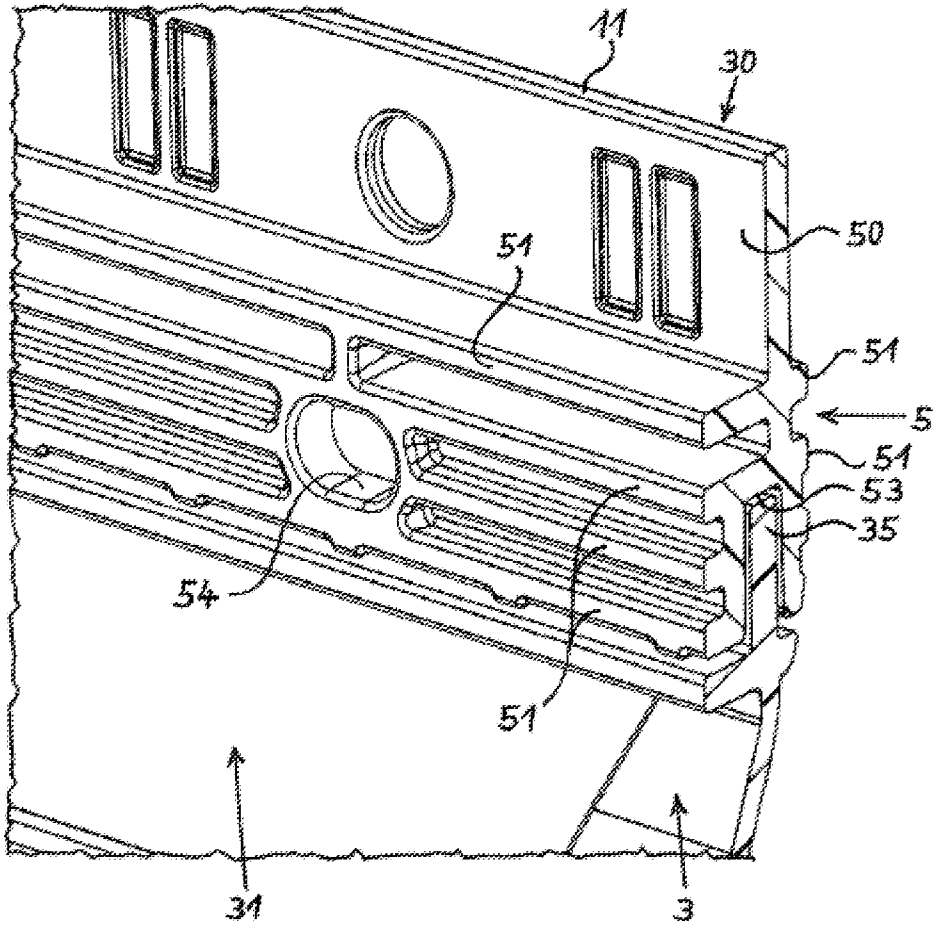

FIG. 5 shows a portion of the longer lateral wall 3 and the reinforcement profile 5 connected thereto in an enlarged illustration, partially in a front view and partially in a first vertical section. At the sectional area located at the right in FIG. 5 it is discernible how the reinforcement profile 5 is placed with its groove 53 onto the brace 35 at the upper edge of the lateral wall 3 in a form-fitting fashion.

Furthermore, FIG. 5 shows that the reinforcement profile 5 also shows at its surface, which is facing away from the viewer and pointing to the interior of the container, lateral profile wings 51, extending parallel to each other in the longitudinal direction of the reinforcement profile 5, for effective stiffening.

Figure 6:
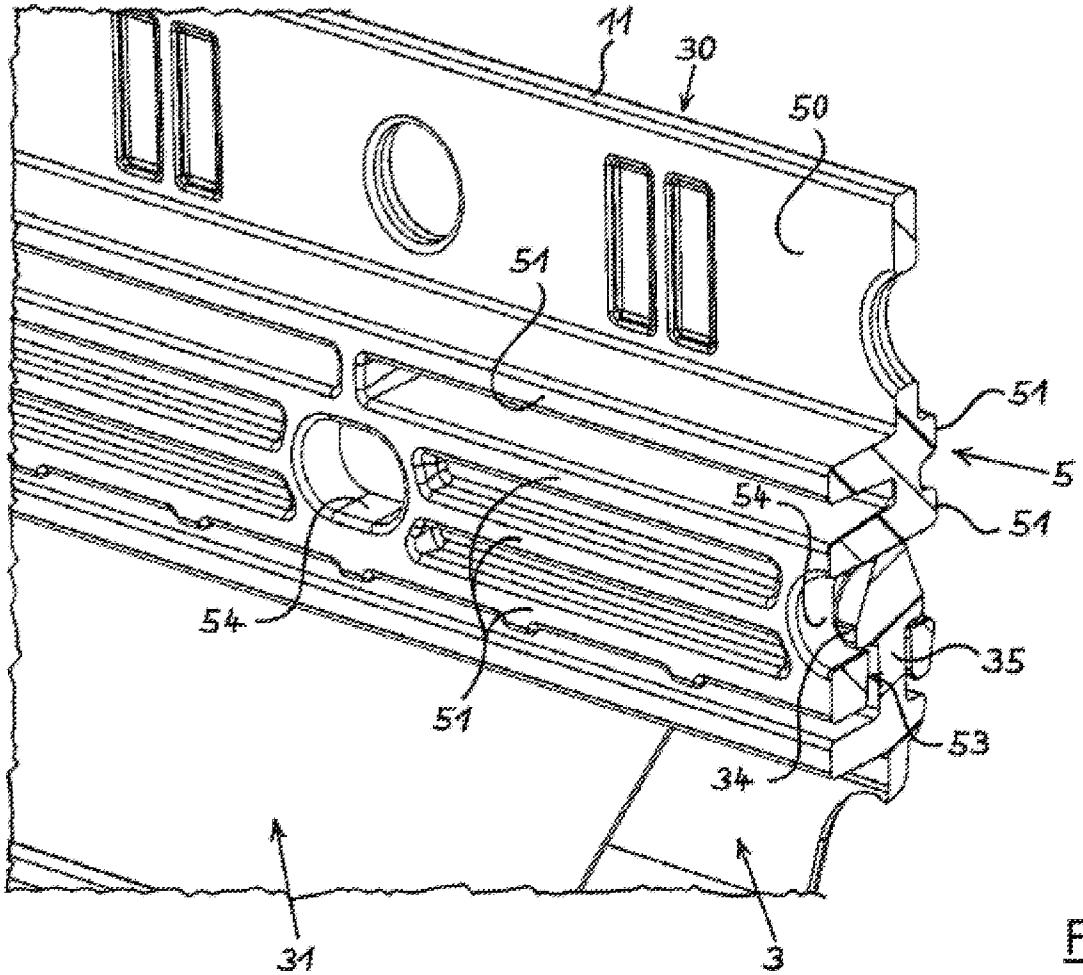

FIG. 6 shows a portion of the longer lateral wall 3 and the reinforcement profile 5 connected thereto in an enlarge illustration, partially in a front view and partially in a second vertical section. The section extends here through one of the pairs of latching elements 34, 54 so that their cooperation is particularly clearly discernible, here.

Figure 7:
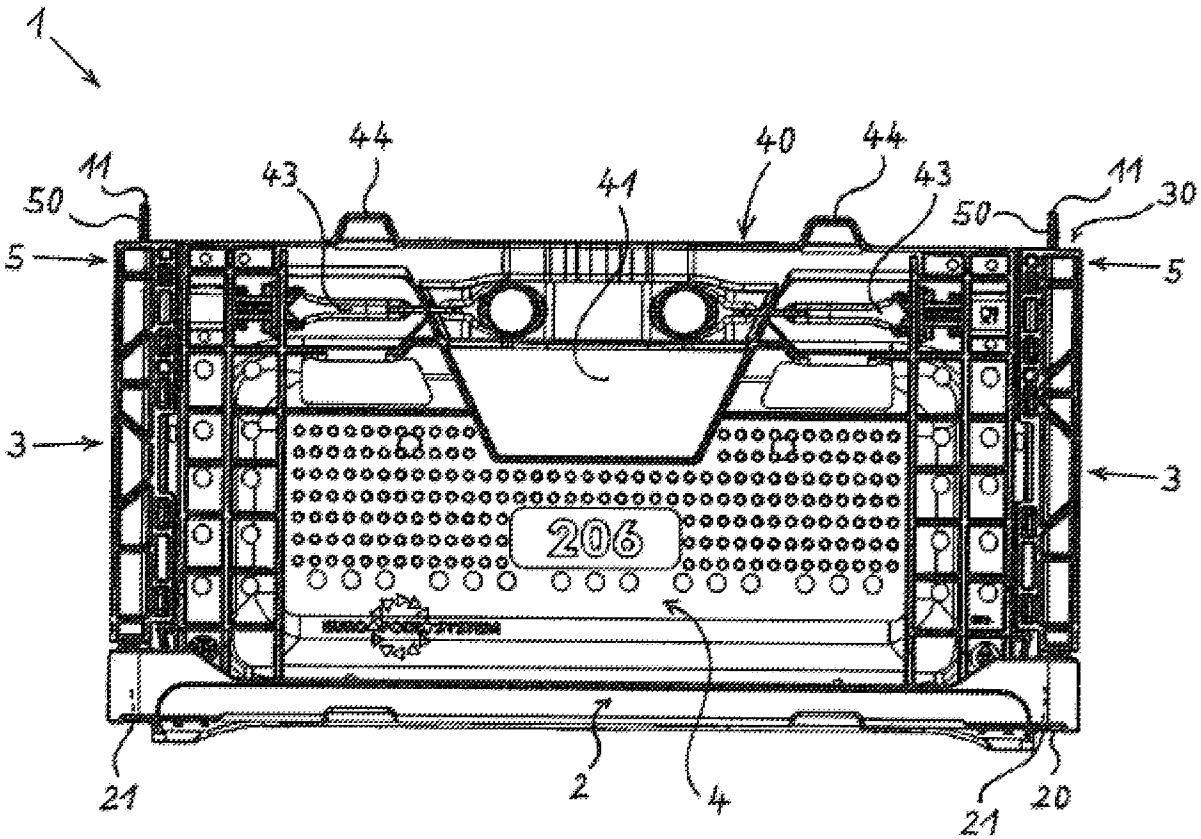

FIG. 7 shows a container 1 with respectively one reinforcement profile 5 at two longer lateral walls 3 opposite each other, in a front view of a shorter lateral wall 4. At the left and the right in FIG. 7 accordingly one of the two longer lateral walls 3 is therefore provided. At the bottom of FIG. 7 the base 2 is located with its bottom stacking contour 20.

At the top, the container 1 shows at the shorter lateral wall 4, facing the viewer, the stacking contour 40 forming the upper edge. At a distance from the upper edge and offset towards the bottom a handle opening 41 is provided in the lateral center of the lateral wall 4. Above the handle opening 41, parallel to the area of the lateral wall 42, two resilient locking means 43 extend, which are displaceable in the horizontal direction. Two upwards projecting protrusions 44 are formed at the upper edge of the lateral wall 4 at a distance from each other, which serve to secure a conventional container placed onto the container 1, showing the same basic dimensions, in a coinciding stacking position in reference to the container 1 and block any displacement of the upper, conventional container along the sliding tracks 11 out of the coinciding stacking position.

The corresponding stacking contours 30 are visible at the left and the right in FIG. 7, along the upper edge of the two lateral walls 3. The stacking contours 30 are here respectively formed by one of the reinforcement profiles 5, latched respectively at the top of the remaining lateral wall 3, which in turn show at the top a profiled section web 50 extending in the longitudinal direction, with its top respectively forming the sliding track 11.

At its longitudinal sides, extending in FIG. 7 at the left and the right perpendicular to the drawing level the base 2 shows, a groove 21 open toward the bottom, which is arranged coinciding with the profiled section web 50. When an identical container 1 is placed onto the container 1, at first offset in the longitudinal direction of the sliding tracks 11, the upper container 1 can be displaced via its grooves 21 on the sliding tracks 11 of the lower container 1 in a position elevated during the shifting to a final stacked position coinciding with that of the lower container 1, in which then the upper container 1 is lowered in reference to the lower container 1 by the cooperation of the appropriately designed sliding tracks 11 and the grooves 21 into its final stacking position.

Figure 8:
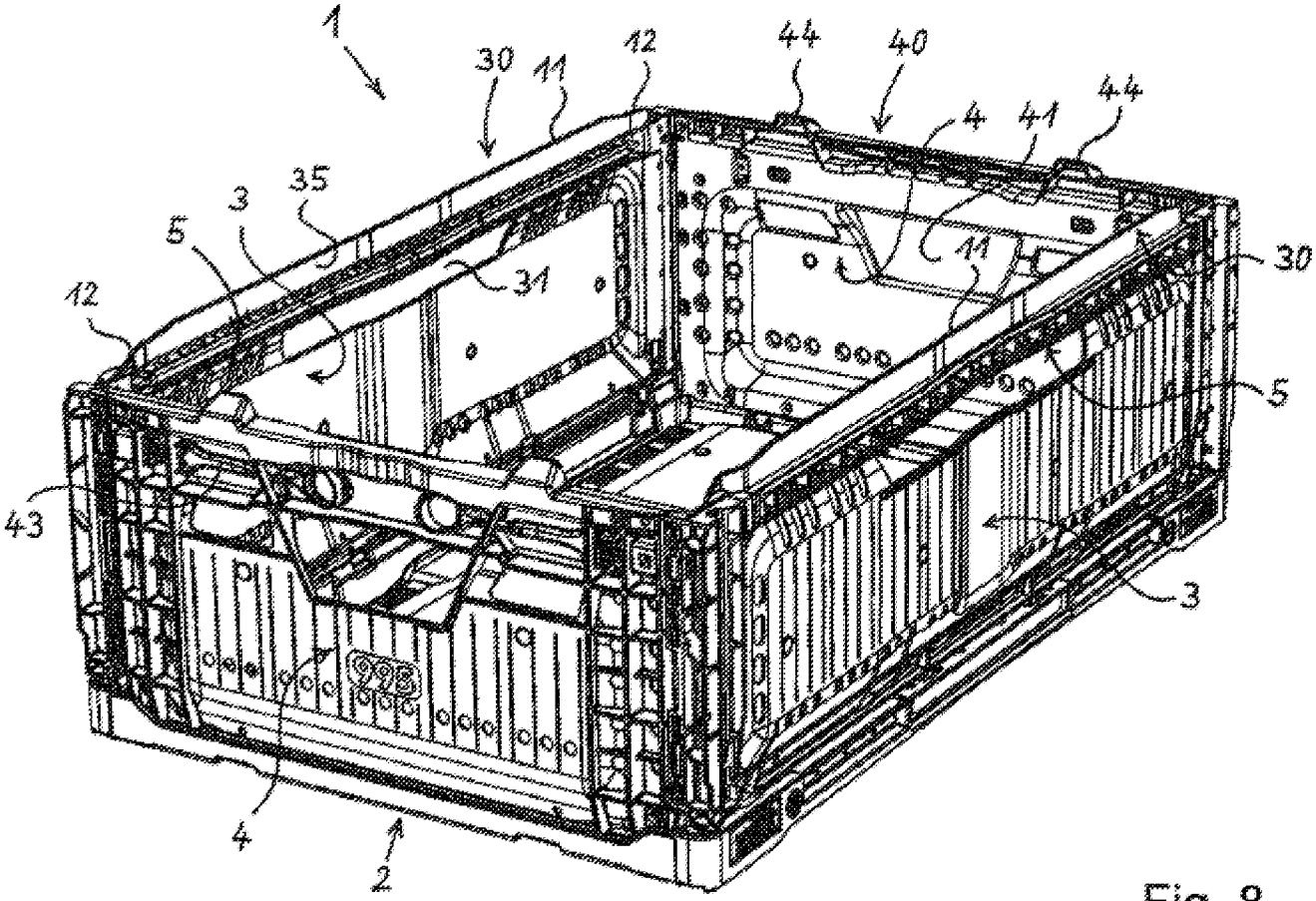

FIG. 8 shows another container 1 with respectively one reinforcement profile 5 each at two opposite longer lateral walls 3 in a view diagonally from the top. Unlike the container according to FIG. 1, here the reinforcement profiles 5 are embodied as insertion parts, which are inserted as prefabricated parts during the production of the container 1 or its lateral walls 3 into an injection mold, in which then the remaining lateral wall is molded, causing the reinforcement profiles 5 to be securely connected to the respectively remaining lateral wall 3.

The sliding tracks 11 at the top of the stacking contours 30 of the longer lateral walls 3 are here not a portion of the reinforcement profiles 5 but a portion of the remaining lateral walls 3 and embodied respectively at the top of the brace 35 formed in one piece at the top of the lateral wall 3.

With regards to the other parts and details of the container 1 shown in FIG. 8 reference is made to the description above.

Figure 9:
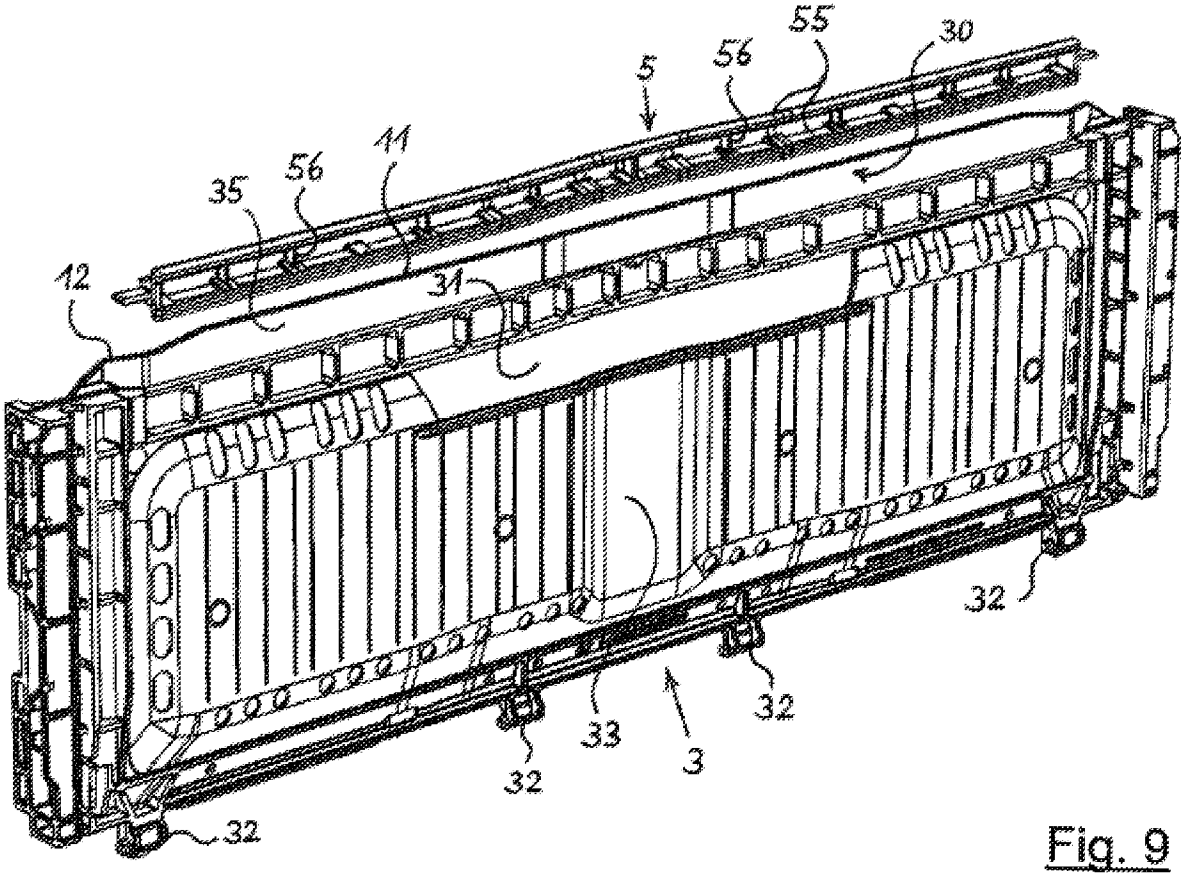

FIG. 9 shows one of the longer lateral walls 3 of the container of FIG. 8 and, separated therefrom, a corresponding reinforcement profile 5, in a view diagonally from the top. As discernible from FIG. 9 here the reinforcement profile 5 shows two longitudinal braces 55 extending parallel to each other and in the longitudinal direction of the reinforcement profile 5 as well as several lateral braces 56 connecting them to each other and distanced from each other in the longitudinal direction. In the finished state of the lateral wall 3 the synthetic material of the remaining lateral wall 3 covers the lateral braces 56 of the reinforcement profile 5, by which it is securely connected to the remaining lateral wall 3.

Further, it is clearly discernible from FIG. 9 that here the sliding track 11 is formed at the top of the brace 35 of the stacking contour 30 of the lateral wall 3, thus is not a part of the reinforcement profile 5.

Figure 10:
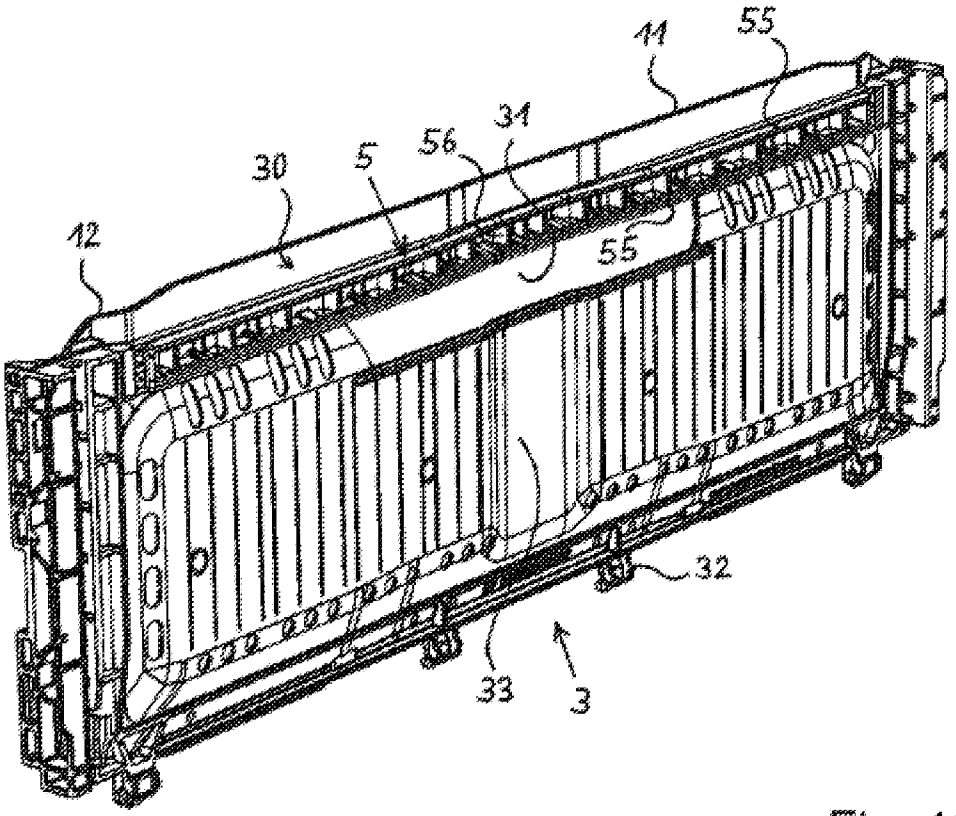

FIG. 10 shows the lateral wall of FIG. 9 with the reinforcement profile 5 connected thereto, once more in a view diagonally from the top. Here, it is particularly visible that the reinforcement profile 5 extends below the sliding track 11 and forms with its top, together with the top edge of the lateral wall 3, a portion of the stacking contour 30.

Figure 11:
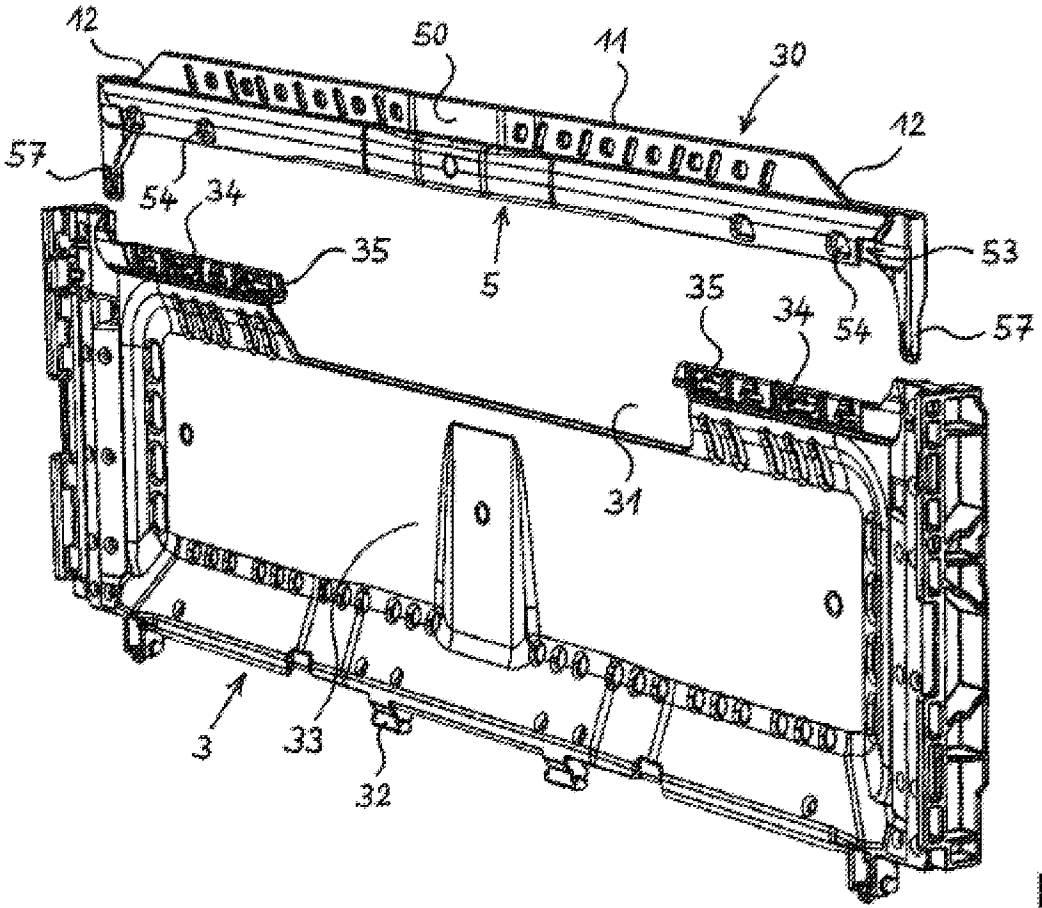

FIG. 11 shows one of the longer lateral walls 3 of another container 1 and a reinforcement profile 5 not yet connected thereto, in a view diagonally from the top. In this exemplary embodiment the reinforcement profile 5 can be latched with the remaining lateral wall by insertion in the direction from the top towards the bottom, for which purpose the lateral wall 3 comprises latching elements 34 and the reinforcement profile 5 shows latching elements 54 cooperating therewith.

On its facial end the reinforcement profile 5 shows here a guide pin 57 pointing downwards, which can be accepted in an appropriate recess near the lateral edges of the lateral wall 3. The guide pins 57 prevents particularly the tipping of the reinforcement profile 5, which here shows a profiled section web 50 pointing upwards and showing a sliding track 11 at the top, on which during the stacking process of containers 1 the weight of the respectively upper container rests during its displacement to the coinciding stacked position.

Figure 12:
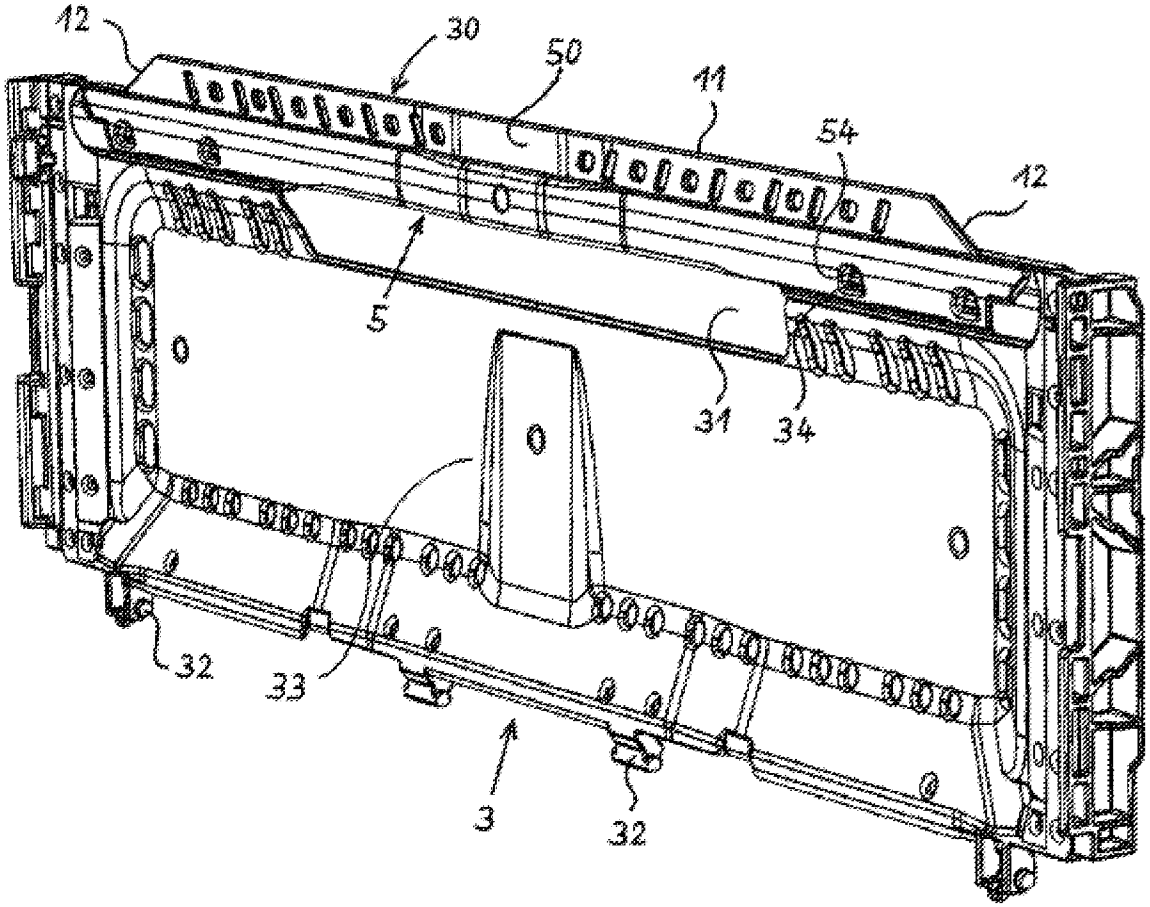

FIG. 12 shows the lateral wall 3 of FIG. 11 and the reinforcement profile 5 connected thereto, also in a view diagonally from the top. The latching element 34 of the lateral wall 3 and the latching elements 54 of the reinforcement profile 5 are now engaged in a latching fashion with each other and secure the reinforcement profile 5 in its assembled position at the lateral wall 3. The profiled section web 50 projects from the reinforcement profile 5 towards the top, extending in its longitudinal direction, with the top there forming the sliding track 11 with its end sections 12 extending down in a sloped fashion.

Figure 13:
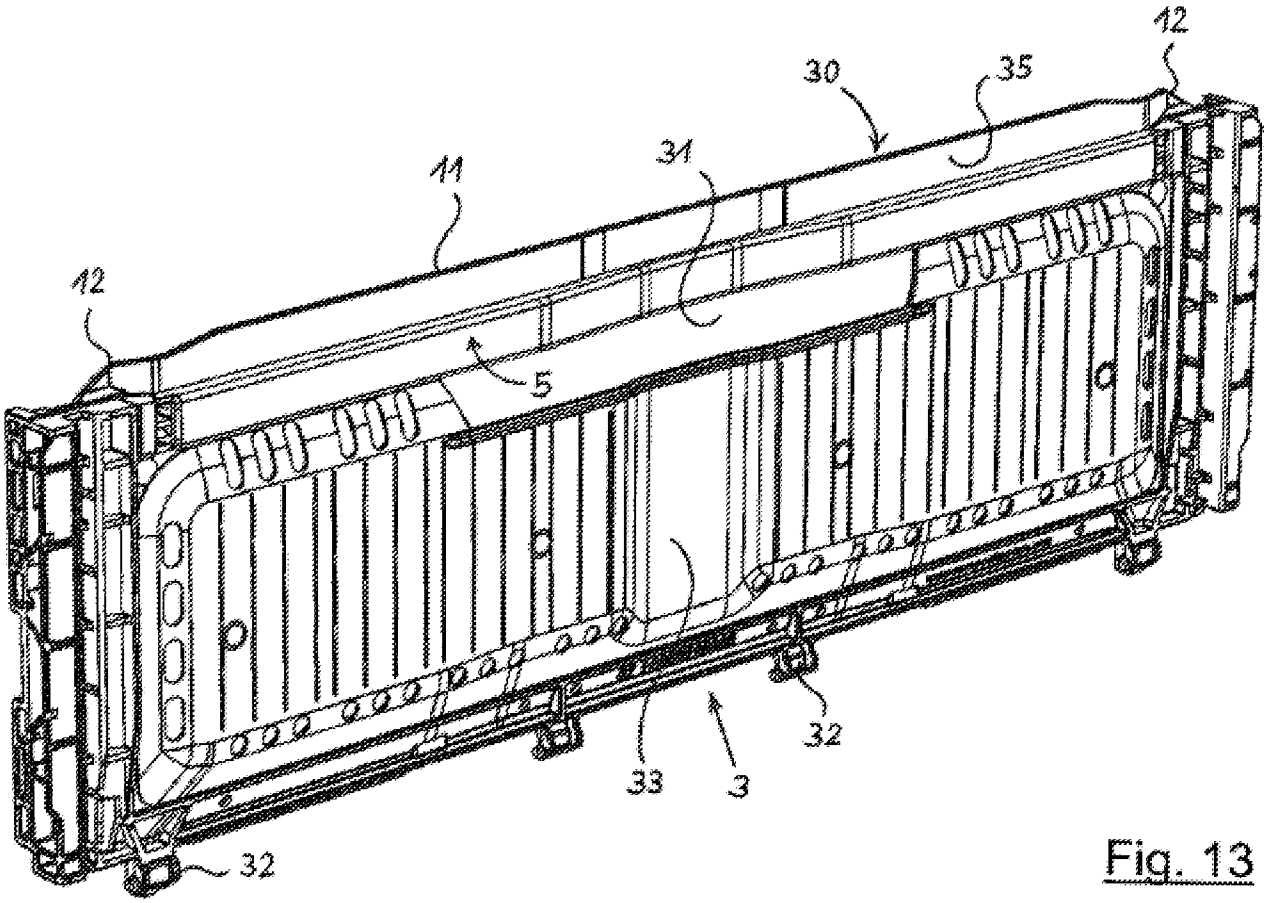

FIG. 13 finally shows one of the longer lateral walls 3 of another container 1 and a reinforcement profile 5 connected thereto in a view diagonally from the top. It is characteristic for the exemplary embodiment shown here that the reinforcement profile 5 is welded to the remaining lateral wall 3 or that the lateral wall 3 including the reinforcement profile 5 is produced as a two-component injection-molded part. In both embodiments, which cannot be distinguished visually by their appearance, the reinforcement profile 5 is connected in a particularly secure and lasting fashion to the remaining lateral wall 3.

The sliding track 11 is here formed at the top of a brace 35 of the stacking contour 30 of the lateral wall 3, thus in this exemplary embodiment it is not a part of the reinforcement profile 5.

LIST OF REFERENCE CHARACTERS

| Character | Reference |
|---|---|
| 1 | Container |
| 11 | Sliding track |
| 12 | End sections of 11 |
| 2 | Base of 1 |
| 20 | Stacking contour at 2 |
| 21 | Grooves in 20 |
| 3 | first, longer lateral walls |
| 30 | Stacking contour at 3 |
| 31 | Handle opening in 3 |
| 32 | Hinges at 3 |
| 33 | flexible wall section of 3 |
| 34 | Latching elements at 3 |
| 35 | Brace at the top edge at 3 |
| 4 | second, shorter lateral walls |
| 40 | Stacking contour/top edge at 4 |
| 41 | Handle opening in 4 |
| 43 | Locking means |
| 44 | Projections at 4 |
| 5 | Reinforcement profiles |
| 50 | Profiled section web top at 5 |
| 51 | Profile wing laterally at 5 |
| 53 | Groove at the bottom in 5 for 35 |
| 54 | Latching elements at 5 |
| 55 | Longitudinal braces |
| 56 | Lateral braces |
| 57 | Guide pins |

The invention claimed is:

1. A plastic container (1), comprising:

a base (2);

first and second pairs of lateral walls (3, 4) joined with said base (2), a pair of reinforcement profile members (5) each configured for attachment with a respective one of said first pair of lateral walls (3), wherein each of said first pair lateral walls (3) comprises a brace (35) defining an upstanding portion extending from a top edge of said each lateral wall (3), said brace (35)

comprising a plurality of projections (34) disposed along a longitudinal axis thereof, each of said reinforcement profile members (5) comprises a web (50) and a plurality of wing portions (51), said web (50) being disposed parallel to and offset from said brace (35) in response to attachment of a said reinforcement profile member (5) to a respective one of said first pair of lateral walls (3), said reinforcement profile members (5) each comprise, among said wing portions (51) and along a longitudinal direction of said each reinforcement profile member (5), a plurality of openings (54) each configured to respectively receive a respective one of said plurality of projections (34) of said brace (35), and a groove (53) matingly engaging said upstanding portion of said brace (35) of said first pair of lateral walls (3) and disposing said plurality of wing portions adjacent said upstanding portion of said brace (35), and said each web (50) of said reinforcement profile members (5) defines, at an upper portion thereof, a sliding track (11) disposed to form a first stacking contour (30) configured for stacking of said container (1) with another container of matching construction as said container (1).

2. A container according to claim 1, wherein said first stacking contour (30) is disposed at a top of a said respective reinforcement profile member (5).

3. A container according to claim 1, wherein said projections (34) and said openings (54) define cooperating latch elements.

4. A container according to claim 1, wherein said base (2) defines a second stacking contour (20) comprising a groove (21) configured to receive therein a web (50) of a said reinforcement profile member (5) as defined by said another container of matching construction as said container (1), and wherein said second pair lateral walls (4) are not equipped with sliding tracks (11) and comprise at each of their top edges two or more projections (44) distanced from each other in the longitudinal direction of the second pair lateral walls (4) to secure a conventional container placed upon said container (1) from displacement in the longitudinal direction of the sliding tracks (11), with the height of the projections (44) being equivalent to the height of the sliding tracks (11), and wherein the projections (44) are distanced from each end of the second pair lateral walls (4).

5. A container according to claim 4, wherein each sliding track (11) is stepped or sloped or rounded at its end sections (12).

6. A container according to claim 1, wherein each of said first and second pairs of lateral walls (3, 4) and said base (2) are formed as any one of a one-piece construction and a multi-piece construction in which said first and second pairs of lateral walls (3, 4) are joined with the base (2) to articulate toward a center of said container (1).

* * * * *